United States Patent [19]

Berger et al.

[11] 4,096,556

[45] Jun. 20, 1978

[54] LAMP HARP

[75] Inventors: Sidney Berger, Great Neck; Salvatore Buda, East Hills, both of N.Y.

[73] Assignee: Berger Industries, Inc., Maspeth, N.Y.

[21] Appl. No.: 739,024

[22] Filed: Nov. 4, 1976

[51] Int. Cl.[2] ..... F21V 17/00

[52] U.S. Cl. ..... 362/417; 362/452

[58] Field of Search ..... 240/91, 148, 52.3; 362/399, 417, 452, 409, 412

[56] References Cited

U.S. PATENT DOCUMENTS

| | | | |
|---|---|---|---|
| 1,946,959 | 2/1934 | Auerbach | 362/452 |
| 2,408,522 | 10/1946 | Leef | 362/452 |
| 2,420,471 | 5/1947 | Engel | 362/417 |
| 2,435,954 | 2/1948 | Berger | 240/148 |
| 2,650,294 | 8/1953 | Berger | 240/148 |
| 2,662,166 | 12/1953 | Berger | 362/452 |
| 2,670,432 | 2/1954 | Benander | 362/417 |
| 2,802,098 | 8/1957 | Chilo | 240/148 |
| 2,895,041 | 7/1959 | Shoglow | 362/417 |
| 3,527,934 | 9/1970 | Bergman | 362/417 |

*Primary Examiner*—J D Miller
*Assistant Examiner*—Peter S. Wong
*Attorney, Agent, or Firm*—Kirschstein, Kirschstein, Ottinger & Cobrin

[57] ABSTRACT

A lamp harp includes a stiff bracket and a resilient bail. The bracket has a base and diametrically opposed bracket arms extending upwardly from the base. Each arm has a hollow interior and includes a channel portion which is formed by a pair of opposed parallel side walls and a base wall. At the point of transition from the channel portion to a U-shaped portion which joins the channel to the base is retaining means in the form of tabs which may be integrally formed with the side walls of the U-shaped portions to enclose the hollow interiors of the arms. Lateral slots are provided in the side walls of the channels immediately above the tabs to form abutment surfaces. The bail includes two downwardly extending free end portions which terminate in end faces and which have spaced above the end faces flats having a substantially rectangular transverse cross-sectional configuration. Each flat forms a foot at the end of the free end portion and is defined by two pairs of shoulders which cooperate with the abutment surfaces and the channels to limit lateral and longitudinal movement of the bail in the bracket.

5 Claims, 7 Drawing Figures

LAMP HARP

BACKGROUND OF THE INVENTION

1. Field of the Invention

The invention relates to a lamp harp and particularly to take-apart lamp harps wherein the bail is connected to or disconnected from the bracket easily.

2. Prior Art

Although take-apart lamp harps are well known in the art, the most widely used conventional harps of this type are relatively complex and cannot be assembled and disassembled with maximum convenience. In most instances the lamp harps include, in addition to the bracket and bail of the harp, such elements as sleeves, slidable along the bail legs which co-act with the bracket for releasably retaining the bail legs attached thereto.

The multi-component structures are relatively expensive to manufacture and somewhat difficult to manipulate. It will be appreciated that the cost of manufacturing the lamp is dependent, in part, on the time needed to assemble the lamp. Therefore, any reduction in the lamp assembly time would be recognized in a reduction in the cost of the lamp.

Because of the relative expense and difficulty in manipulation associated with such multi-component lamp harps, several lamp harps were developed which are composed solely of a bracket and bail. One such harp is described in U.S. Pat. No. 1,946,959 which discloses an adjustable lamp shade in which a clamp having upwardly extending arms is provided with caps at the upper ends of the arms. Each cap has a key slot therein. The bail has a series of slots in its ends. The free ends of the bail are compressed and inserted through the caps and when the bail is at a desired height and the slots are in registry with the key slot the ends are released permitting the slots to engage the lateral portions of the key slots thereby locking the bail to the clamp. While this structure discloses a relatively inexpensive and simple lamp harp and bail combination, the bail can be disengaged easily from the clamp merely by urging the ends of the bail inwardly.

Oftentimes through carelessness, lamps are carried or moved about by an individual gripping the lamp harp and thereby lifting the lamp. In such situations the body of the lamp, which is generally of substantial weight, is supported through the connection between the bail and the bracket. In the prior art, as exemplified by the U.S. Pat. No. 1,946,956, the connection between the bracket and the bail is not designed to sustain the weight of the lamp body suspended from the bail, but merely to secure the relatively light bail and shade to the lamp body. The suspended lamp body can easily separate from the bail resulting in possible damage to the body of the lamp.

It is toward elimination of the foregoing and other difficulties that the present invention is directed.

SUMMARY OF THE INVENTION

1. Purposes of the Invention

It is an object of the present invention to provide a lamp harp which consists only of a bracket and bail thereby eliminating elements shiftable along the bail to detachably engage the bracket arms.

Another object of the present invention is to provide a lamp harp in which the bail can be easily secured to or easily removed from the bracket.

A further object of the present invention is to provide a lamp harp in which the components are of an exceedingly simple and inexpensive construction.

A still further object of the present invention is to provide a lamp harp where assembly and disassembly of the bail and bracket can be quickly and conveniently carried out with very simple manipulations.

A yet further object of the present invention is to provide a lamp harp in which the harp and bail are securely interconnected in a manner such that they cannot be easily disengaged accidentally or deliberately from one another.

Other objects of the present invention in part will be obvious and in part, will be apparent in the following description.

2. Brief Description of the Invention

Generally speaking, the take apart lamp harp includes solely a harp bracket and a harp bail. The harp bracket has a base which is secured, as by clamping, to the body of a lamp fixture. At diametrically opposite ends of the base, and extending longitudinally upwardly, i.e., in a direction upwardly away from the base of the bracket are bracket arms. Each bracket arm has a hollow interior and includes a channel portion formed by a base wall and a pair of spaced opposed parallel side walls extending laterally toward the center of the lamp fixture which terminate in free longitudinal inner side and lateral top edges. The opposed parallel side walls are spaced apart a distance which is less than the diameter of the bail to be hereinbelow described.

The channel portions are connected at their lower ends to opposite sides of the base by sloping downwardly flared U-shaped transverse cross-sectional elements which constitute extensions of the channels and which also have hollow interior portions.

At the point of transition between the channel portion and the sloping portion, the hollow interior of each arm is enclosed by closures which may be tabs integrally formed with each bracket arm along the edges of the side walls of the sloping portion. This enclosed interior portion of the bracket arm has a transverse cross-sectional configuration adapted to slidingly receive a foot on the bail to be described. A lateral slot is formed in the pair of opposed parallel side walls immediately adjacent the closure to create abutment surfaces thereon.

The bail is formed from a piece of resilient wire having a substantially circular transverse cross-sectional configuration and has straight free end portions which in idle condition of the bail are mutually spaced apart a distance greater than the distance between the base walls of the channels. The free ends will press against the base walls of the channels upon engagement with the bracket arms.

The free end portions of the bail have identical constructions. Each has a substantially flat end face and a flat portion of a substantially rectangular transverse cross-sectional configuration spaced above the end face. The flat has a width slightly less than the width of the opposed parallel side walls so that it can snugly slidingly enter the hollow interior of the channel. A foot having a circular transverse cross-sectional configuration is created at the end of the free end portions by the flat. A first pair of shoulders is formed between the foot and the flat and a second pair of shoulders is formed between the flat and the balance of the bail. These pairs of shoulders constitute abutment means which cooperate with the bracket arms, to secure the bail to the bracket arm.

To couple the bail to the bracket, the free end portions of the bail are manually squeezed toward one another so that the ends are spaced apart a distance less than the distance between the bracket arms. The end portions of the bail are then permitted to move laterally apart with the foot on each end portion entering the lateral slot in the opposed walls of the channel and the flat entering the channel. In this position the bail is connected to the bracket by the laterally outwardly biased end portions of the bail, and the interaction of the first pair of shoulders on each end portion with the abutment edges formed by the slots in the opposed parallel side walls prevent the bail from being displaced longitudinally upwardly from the bracket. However, the bail can be separated easily from the bracket merely by manually exerting a laterally inwardly directed force on the end portions. To move the end portions to a position in which the bail is better secured to the bracket, a longitudinally downwardly directed force, i.e., a force in a direction toward the base of the bracket is exerted on the bail, urging the end portions downwardly in the bracket arms until the second pair of shoulders abut the free top edges of the side walls and the feet are received in the channels. The flat is of a length such that when such abutment occurs the foot on each end portion is positioned within the enclosed interior of the bracket arm. In this second position the foot will strike the closures when any laterally inwardly directed force is exerted on the end portions.

To remove the bail from the bracket a longitudinally upwardly directed force is exerted on the bail so that the second pair of shoulders again strike the abutment surfaces in the side walls, at which point the end portions can be displaced laterally inwardly and removed from the bracket arms.

The invention consists in the features of construction and arrangement of parts which will be detailed hereinafter and described in the appended claims.

BRIEF DESCRIPTION OF THE DRAWINGS

For a better understanding of the present invention, reference should be had to the accompanying drawings wherein like numerals of reference indicate similar parts throughout the several views and wherein.

DESCRIPTION OF THE PREFERRED EMBODIMENT

Figure 1:
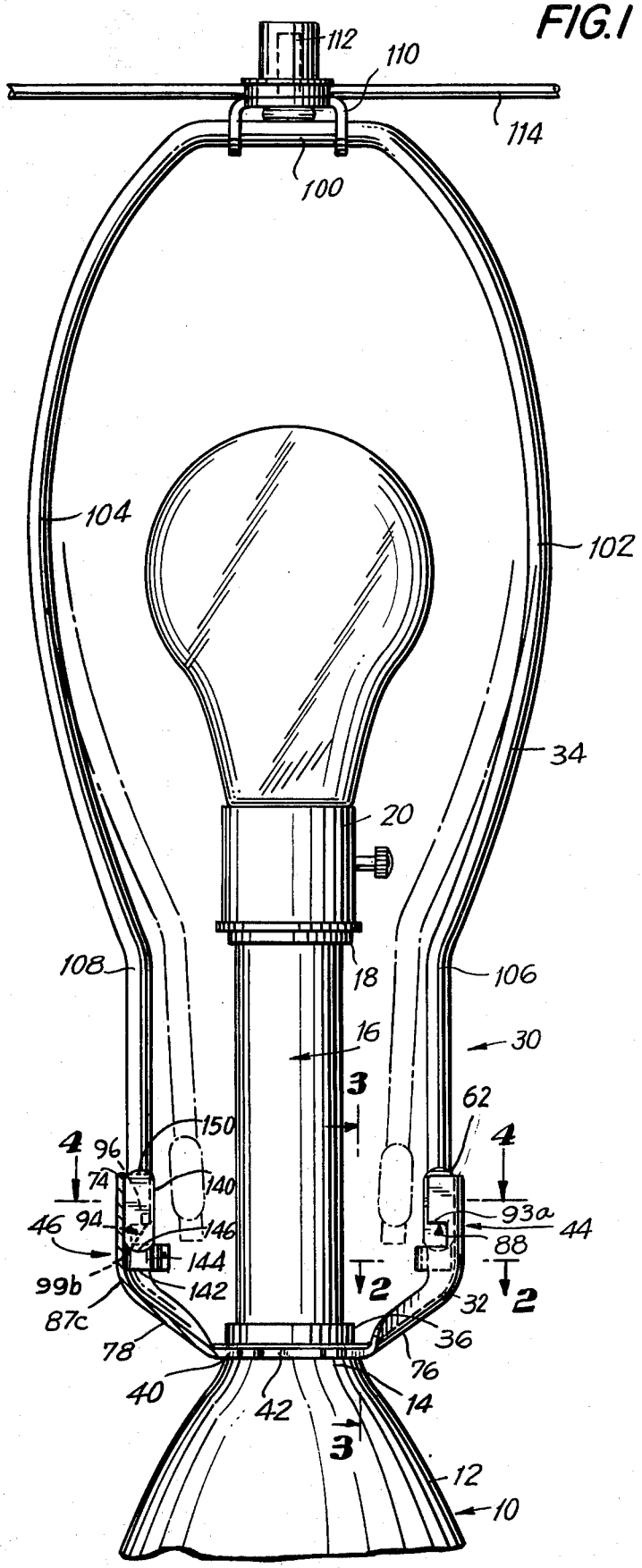
FIG. 1 is a fragmentary elevational view of a lamp fixture showing the lamp harp of the present invention mounted on a lamp; with one of the bracket arms being shown in section

Referring now to FIG. 1, there is illustrated fragmentarily therein a lamp 10 having a base or ornamental support 12. The top end 14 of the ornamental support 12 is formed with an opening through which a nipple 16 or pipe extends downwardly into the interior of the ornamental support 12. The nipple 16 is affixed to the ornamental support in any known way. At its upper end, i.e., its end upwardly beyond the top end 14 of the ornamental support 12, the nipple 16 is screwed into the lower tapped collar 18 of a standard light socket 20. The standard light socket 20 is supplied with electric current through wires 22 (FIG. 4) which extend through the nipple 16 in the conventional manner.

The lamp harp 30 of the present invention which consists in its entirety of a bracket 32 and a bail 34 is firmly clamped between the socket 20 and the top 14 of the ornamental support 12 by a tapped collar 36 which is screwed onto the nipple 16. It will be appreciated by those skilled in the art that other conventional means can be employed to secure the lamp harp 30 to the ornamental support 12. For example, the nipple 16 need only project beyond the end 14 of the support 12 a length sufficient to permit the lamp harp 30 to be clamped between the socket 20 and the ornamental support 12 when the socket 20 is firmly affixed to the nipple 16.

The bracket 32 which may be fabricated from a single piece of sheet metal by suitable punching, swagging, and bending operations includes a flat base 40 formed with a central opening 42 to permit the bracket 32 to be slipped on the nipple 16 and clamped between the collar 36 and the ornamental support 12 as described. The bracket 32 is secured to the ornamental support 12 so it can be shipped therewith, the bail 34 however being removed before shipping.

Figure 4:
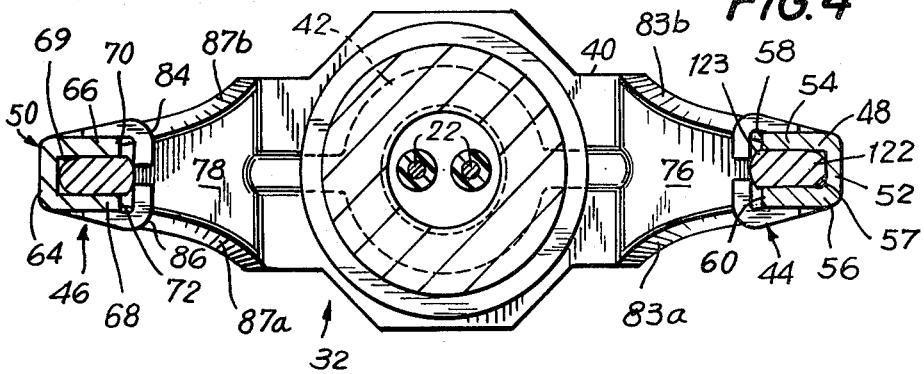
FIG. 4 is an enlarged sectional view taken substantially along the line 4—4 of FIG. 1.

The bracket 32 also includes two substantially erect arms 44 and 46 located at diametrically opposite sides of the base 40 as can best be seen in FIG. 4. The arms 44 and 46 have hollow interiors and include elongated channel portions 48 and 50 respectively which have generally U-shaped transverse cross-sectional configurations. The horizontal transverse cross-sectional configuration of the channel 48 includes a base wall 52 and a pair of parallel opposed side walls 54 and 56 which create a portion of the hollow interior area 57 in the arm 44. These parallel opposed side walls extend inwardly toward the center of the fixture and terminate in free longitudinal inner side edges 58 and 60 and free lateral top edges 62. Similarly, the channel 50 has a base 64 with inwardly extending opposed parallel side walls 66 and 68 which create a portion of the hollow interior area 69 in the arm and which terminate in free longitudinal inner side edges 70 and 72 respectively. The opposed parallel side walls 66 and 68 also are provided with free lateral top edges 74. The opposed parallel side walls by extending inwardly toward the center of the fixture result in the hollow interiors 57 and 69 of the channels 48 and 50 being directed toward each other.

The channel portions 48 and 50 are connected at their lower ends to opposite sides of the base 40 by downwardly flared sloping elements 76 and 78 respectively which constitute generally U-shaped transverse cross-sectional extensions of the channels. The hollow interior of the channels extend into the elements 76 and 78.

Figure 3:
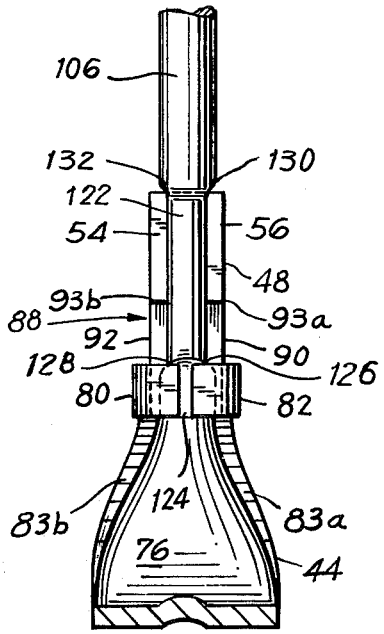
FIG. 3 is an enlarged sectional view taken substantially along the line 3—3 of FIG. 1.

On each arm, at the point of transition between the channel portion and the sloping portion is an area in which the interior portion of the arm is substantially fully enclosed. As best seen in FIG. 3, the hollow interior 57 of the arm 48 is enclosed by closure means which may be tabs 80 and 82 that are integrally formed with the side walls **83*a* and 83*b* of the sloping element 76. Similarly, at the point of transition from the channel 50** to the sloping portion 78 the hollow interior 69 is substantially fully enclosed by tabs 84 and 86 on the side walls 87*a* and 87*b* of the sloping element 78. It will be appreciated by those skilled in the art that the enclosed interior portion may be created by utilizing alternative structures such as elements soldered to the edges of the side walls.

Figure 2:
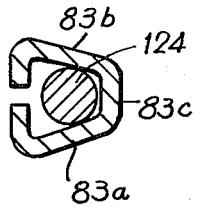
FIG. 2 is an enlarged sectional view taken substantially along the line 2—2 of FIG. 1.

As can best be seen in FIG. 2, the side walls 83*a* and 83*b* are flared outwardly, i.e., diverging from each other from the base wall 83*c* to provide a transverse cross-sectional configuration adapted to slidingly receive feet on the free end portions of the bail which will be described. Similarly, the side walls 87*a* and 87*b* diverge from the base wall 87*c*.

For reasons which will become apparent as this description proceeds, the channels are provided with abutment surfaces. Thus, the arm 44 has a lateral slot 88 in the channel portion 48 formed by cutouts 90 and 92 in the pair of opposed parallel side walls 54 and 56 immediately above the tabs 80 and 82 respectively to form abutment surfaces 93*a* and 93*b*. Similarly, the arm 46 is provided with a lateral slot 94 formed by cutouts 96 and 98 (not shown) in the opposed parallel side walls 66 and 68 immediately above the tabs 84 and 86 respectively to form abutment surfaces 99*a* and 99*b* (not shown).

As used in the specification and the claims, the terms "longitudinally upwardly" and "longitudinally downwardly" are used with reference to the base of the bracket herein described. That is, "longitudinally upwardly" refers to a vector extending away from the base and away from the support. Conversely, "longitudinally downwardly" refers to a vector extending downwardly from the base. Similarly, "laterally outwardly" and "laterally inwardly" are used with reference to the base walls of the channels. "Laterally outwardly" refers to a vector extending from the base walls of one channel away from the base walls of the other channel and "laterally inwardly" refers to a vector extending from the base wall of one channel toward the base wall of the other channel.

The bail 34 includes a piece of metal wire or like resilient material bent into the shape shown in FIG. 1 so as to include a flat top portion 100, outwardly bowed intermediate portions 102 and 104 extending from opposite ends of the top portion 100 and straight free end portions 106 and 108 extending downwardly respectively from the outwardly bowed intermediate portions. For reasons which will become apparent, when disengaged from the harp bracket 32, the end portions 106 and 108 are mutually spaced apart a distance greater than the distance between the base walls 52 and 64 of the channels 48 and 50 respectively. Therefore, the ends will press against the base walls, i.e., will be biased laterally outwardly upon engagement with the arms as will hereinafter be described.

Except for the configuration of the end portions 106 and 108, the bail is of a conventional construction and has a substantially circular transverse cross-section. Fixed to the top portion 100 is a swivel fixture 110 of common construction or other suitable means to receive a finial 112 by means of which a lamp shade, a portion of which is identified by reference numeral 114 in FIG. 1, is secured to the bail.

The end portions 106 and 108 of the bail 34 have identical constructions. As can best be seen in FIG. 5, the end portion 106 has a substantially flat end face 120. Spaced above the end face 120 is a flat 122 having a substantially rectangular transverse cross-sectional configuration (FIG. 4). The flat 122 has a width slightly less than the width of the opposed parallel side walls 54 and 56 so that it can snugly slidingly enter laterally into the channel 48 of the arm 44 and fill the hollow interior 57. To facilitate proper introduction of the flat 122 into the hollow interior 57, the corners 123 of the flat may be rounded as shown. The flat 122 serves to form a foot 124 proximate the end face 120 which has a substantially circular transverse cross-sectional configuration matching the cross-sectional configuration of the balance of the bail. Because of the variation in the transverse cross-sectional configuration of the end portion 106 caused by the flat 122, shoulders are created at the points of transition from the foot 124 to the flat 122 and from the flat to the balance of the end portion 106. As illustrated in FIG. 3, there is formed between the foot 124 and the flat 122 a pair of shoulders identified as 126 and 128. Similarly, shoulders 130 and 132 are formed between the flat 122 and the balance of the free end portion 106.

The free end 108 has a flat 140 spaced above the substantially flat end face 142 which creates a foot 144 and shoulders 146, 148, 150 and 152 thereon. Shoulders 148 and 152 cannot be seen in the drawings; however, it will be appreciated by those skilled in the art that the recitation made herein of the identity in structure of end portions 106 and 108 implies that the end portion 108 is provided with such shoulders.

The construction of the end portions just described cooperates with the structure of the bracket arms 44 and 46 to selectively couple the bail 34 to the bracket 32.

Figure 5:
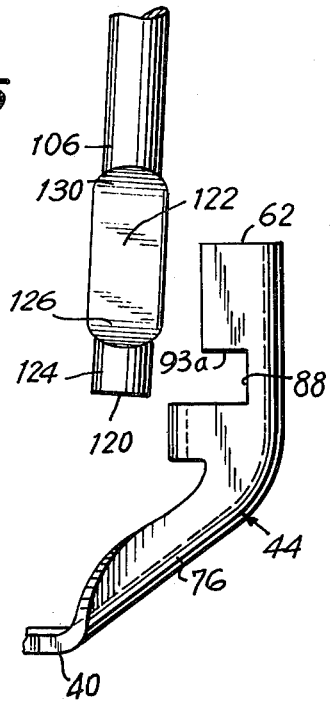
FIGS. 5, 6 and 7 are enlarged frontal elevational views of an end portion of the bail and its associated bracket arm showing the sequential positioning of the end portion with respect to the bracket arm as the end portion is positioned in and coupled to the bracket arm.
Figure 6:
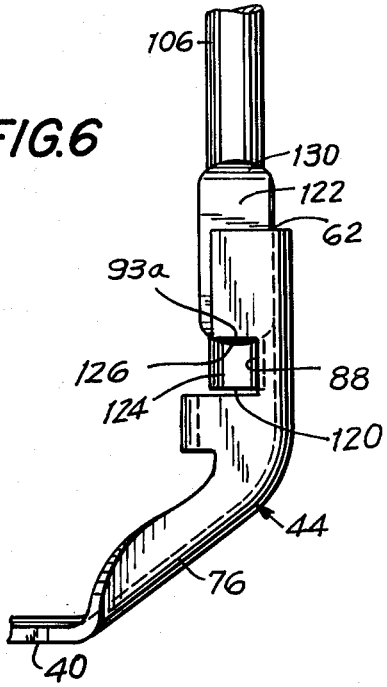
Figure 7:
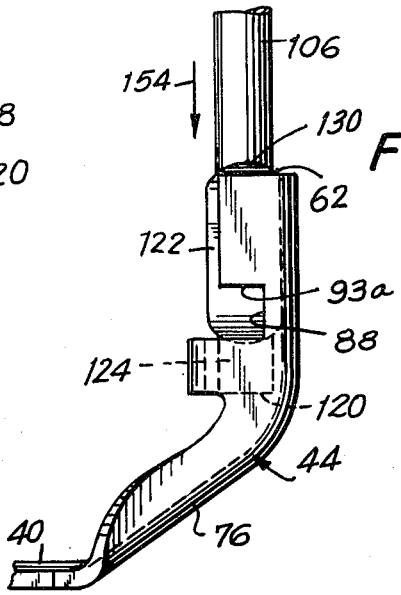

The manner in which the bail 34 is secured to the bracket 32 is illustrated sequentially in FIGS. 5, 6 and 7 wherein only the end portion 106 and the bracket arm 44 are illustrated. It will be appreciated however that the end portion 108 and the bracket arm 46 cooperate in an identical manner.

As mentioned hereinabove, the end portions 106 and 108 of the bail when in their unstressed condition are spaced apart a distance greater than the base walls 52 and 64 of the channels 48 and 50. Therefore, to couple the bail to the bracket, the end portions 106 and 108 must be urged laterally inwardly toward each other so that the ends of the bail occupy positions with respect to the arms as is shown in FIG. 5. The end portions 106 and 108 of the bail are then permitted to spring laterally outwardly so that the foot 120 will enter the lateral slot 88 in the opposed side walls of the channel 48 and the flat 122 is snugly slidingly received in the channel 48. With the end portions 106 and 108 placed in this position with respect to the bracket arms 44 and 46, the bail 34 is connected to the bracket by the laterally outwardly biased end portions of the bail. The bail cannot be displaced longitudinally upwardly from the bracket since the shoulders 126 and 128 will abut the abutment surfaces 93*a* and 93*b* respectively. However, the bail can be easily separated therefrom by merely exerting a laterally inwardly directed force on the end portions of the bail so that they are displaced from the channels. To move the end potions 106 and 108 into a second position in which the bail is securely coupled to the bracket, a longitudinally downwardly directed force, as indicated by arrow 154 (FIG.7) is exerted on the end portions 106 and 108. With respect to the end portion 106 the shoulders 130 and 132 abut the free top edges 62 of the side walls 54 and 56. The flat 122 is dimensioned so that when the end portion 106 is in the second position, the foot 124 is positioned within the enclosed interior portion of the arm 44. Similarly, the foot 144 on the end portion 108 will be positioned within the enclosed interior position of the arm 46. Any laterally inwardly directed force exerted on the end portions 106 and 108 will cause the feet 124 and 144 to strike the tabs 80 and 82, and 84 and 86 respectively thereby preventing displacement of the end portions from the arms 44 and 46.

In this condition, the bail cannot be accidentally detached from the bracket to avoid separation as might occur while the lamp is carried by an individual inadvertently or unwisely gripping the bail.

To detach the bail from the bracket, a longitudinally upwardly directed force is exerted on the bail 34 so that the shoulders 126 and 128 strike the abutment surfaces 93*a* and 93*b* respectively, and the shoulders 146 and 148 strike the abutment surfaces 99*a* and 99*b* respectively. The end portions 106 and 108 are then forced laterally inwardly toward each other until the feet 124 and 144 clear the slots 88 and 94 and the flats 122 and 140 clear the channels 48 and 50 respectively.

It can be seen from the foregoing detailed description that the objects of the present invention, namely to create a new lamp bail and lamp bracket construction in which the components can be attached and detached easily, have been achieved by providing a lamp harp including a bracket having two upwardly directed diametrically opposed arms. Each arm has a channel portion with a base wall and two laterally extending parallel side walls. Each channel is joined to the base of the bracket by a generally U-shaped transverse cross-sectional portion. Ringlike closure means is provided which encloses a hollow interior of the arm at the point of transition from the channel to the U-shaped portion. Immediately adjacent the abutment means are a slot and abutment surfaces formed by cutouts extending laterally into the parallel side walls of the channel.

The lamp harp also includes a bail of a generally circular transverse cross-sectional configuration having identically constructed elongated free end portions. Each end portion terminates in a flat end face. Spaced inwardly along the end portion from the end face is a flat or an area of a substantially rectangular transverse cross-sectional configuration to create a foot proximate the end face. The flat also creates shoulders on the end portion. A first pair of shoulders is formed between the flat and the foot and a second pair of shoulders is formed between the flat and the balance of the bail. The end portions are mutually spaced apart a distance greater than the distance between the base walls of the channels so that when the end portions are placed in the bracket arms, they will bear against the base walls.

To secure the bail of the bracket arm, the end portions are first moved laterally inwardly towards each other so that the distance between them is less than the distance between the bracket arms. The foot on each of the end portions is aligned with the cutout in the associated bracket arm and the end portions are allowed to separate or move laterally outwardly with the feet being positioned within the cutouts and the flats within the hollow interiors of the channels. In this first position, the first pairs of shoulders on the end portions cooperate with the slots in the bracket arms to prevent the bail from being pulled longitudinally upwardly from the bracket arms, but the end portions are free to move towards each other or laterally inwardly when they are subjected to a laterally inwardly directed force. The bail is further secured to the bracket by urging longitudinally downwardly so that second pairs of shoulders abut the free top edges of the arms and the feet are captively received within the enclosed hollow interior portion of the arm. When in the second position, if an inwardly directed lateral force is applied to the end portions, the feet will be prevented from moving out of the bracket arm and thereby the bail is coupled to the bracket. To remove the bail from the bracket, the procedure immediately described is reversed.

While in accordance with the patent statutes, a preferred embodiment of the present invention has been illustrated and described in detail, it is to be particularly understood that the invention is not limited thereto or thereby.

What is claimed is:

1. A lamp harp comprising:

(a) a bracket having a base portion and a pair of upwardly directed bracket arms having hollow interiors on diametrically opposite ends of said base portion;

(b) a channel portion on each of said bracket arms formed by a pair of opposed parallel side walls and a base wall, said side walls directed toward the other of said channels and terminating in free longitudinal inner side edges and free top edges;

(c) a generally U-shaped portion joining said channels to said base having outwardly flaring, diverging side walls;

(d) a resilient wire bail having a pair of opposed legs respectively terminating in elongated free end portions, each of said end portions having an end face;

(e) each of said pair of opposed parallel side walls constructed and arranged to slidingly receive one of said pair of end portions; and (f) means on said bracket arms and said elongated free end portions for selectively securing each of said pair of end portions in its associated bracket arm constructed and arranged to permit lateral outward movement of said end portions into said bracket arms to a first position therein and lateral inward movement of said end portions from said bracket arms when said end portions are in said first position, said means further constructed and arranged to selectively secure said end portions in said bracket arms to prevent lateral inward movement of said end portions from said bracket arms when said end portions are slidingly displaced longitudinally downwardly to a second position with respect to said bracket arms, said means permitting limited upward and downward longitudinal movement of said end portions in said bracket arms between said first and said second positions.

2. A lamp harp in accordance with claim 1 wherein said selectively securing means comprises;

(a) a flat having a substantially rectangular transverse cross-sectional configuration in each of said end portions spaced above said end faces to form a foot proximate each of said end faces, said feet and the balance of said bail having a substantially circular transverse cross-sectional configuration;

(b) a first pair of shoulders formed by said flat adjacent said foot on each end portion;

(c) a second pair of shoulders formed by said flat adjacent the balance of said bail on each end portion;

(d) a first abutment means on said pair of opposed parallel side walls constructed and arranged to co-act with said first pairs of shoulders when said end portions are in said first position to prevent upward longitudinal movement of said end portion with respect to said bracket arms;

(e) a second abutment means on said generally U-shaped portion proximate said first abutment means enclosing said hollow interior of said bracket arms constructed and arranged to prevent inward lateral movement of said end portions when said end portions are in said second position; and (f) said flats being dimensioned so that said feet are positioned within said enclosed hollow interior when said second pair of shoulders abuts said free top edges of said opposed parallel side walls.

3. A lamp harp in accordance with claim 2 wherein said first abutment means includes:

(a) abutment edges created by laterally extending slots in said opposed parallel side walls, said slots constructed and arranged to receive said feet;

(b) said feet having a diameter greater than the space between said parallel side walls so that said feet abut said abutment edges to prevent outward longitudinal movement of said end portions when said end portions are in said first position.

4. A lamp harp in accordance with claim 2 wherein said second abutment means includes a member affixed to said side walls of said generally U-shaped portions to enclose said hollow interior of said bracket arms.

5. A lamp harp in accordance with claim 4 wherein the member constitutes a pair of tabs each integrally formed with a different one of said side walls and bent to enclose said hollow interior of said bracket arms.

* * * * *